United States Patent [19]

Silvestri, Jr. et al.

[11] Patent Number: 4,901,532

[45] Date of Patent: Feb. 20, 1990

[54] SYSTEM FOR ROUTING PRESEPARATOR DRAINS

[75] Inventors: George J. Silvestri, Jr., Winter Park; Homer G. Hargrove, Maitland, both of Fla.

[73] Assignee: Westinghouse Electric Corp., Pittsburgh, Pa.

[21] Appl. No.: 253,290

[22] Filed: Oct. 5, 1988

[51] Int. Cl.[4] ..... F01K 17/00

[52] U.S. Cl. ..... 60/657; 60/646

[58] Field of Search ..... 60/646, 657

[56] References Cited

U.S. PATENT DOCUMENTS

| | | | |
|---|---|---|---|
| 3,320,729 | 5/1967 | Stahl . | |
| 4,527,396 | 7/1985 | Silvestri, Jr. | 60/685 |
| 4,622,819 | 11/1986 | Draper et al. | 60/657 |
| 4,803,841 | 2/1989 | Hargrove et al. | 60/657 |

OTHER PUBLICATIONS

Dr. Peter von Boeckh et al.; "Moisture Separator and Cycle Efficiency Improvements by Installing Moisture Preseparators"; *ASME Journal;* pp. 1–6, (no date).

*Primary Examiner*—Allen M. Ostrager

[57] ABSTRACT

Apparatus for inhibiting flashing of preseparator drain liquid in a steam turbine system includes a pump in the form of an eductor for pumping liquid extracted from exhaust steam between a collection tank and a moisture separator drain tank. The eductor performs the dual function of pumping while cooling the liquid to provide greater differential between the liquid temperatures and the flash point. The apparatus includes controls for preventing flooding and emptying of the collection tank. Further apparatus is provided to cool the liquid in the collection tank by spray water obtained from a lower temperature cycle point.

7 Claims, 4 Drawing Sheets

SYSTEM FOR ROUTING PRESEPARATOR DRAINS

BACKGROUND OF THE INVENTION

This invention relates to steam turbines and, more particularly, to an apparatus for improving the effectiveness of transporting preseparator condensate from drain collection tanks to moisture separator reheaters drain tanks.

The usefulness of preseparators in order to remove liquid entrained in steam flow through the exhaust system of a steam turbine is well-known. Some exhaust pipes, known as crossunder lines, which connect the exhaust of a high pressure turbine with one or more moisture separators or moisture separator reheaters in a nuclear power plant are subject to serious erosion damage unless a preseparator is incorporated. For simplicity, the terms "moisture separator" and "moisture separator reheater" will be used in the alternative and the use of only one term is intended to include either or both, it being recognized that some turbine systems may not include moisture separator reheaters. The erosion problem has been fully explained in several publications. Specifically, U.S. Pat. No. 4,527,396 issued to Silvestri and assigned to Westinghouse Corporation, discloses a moisture preseparator for removing erosion-causing entrained liquid from a moisture-laden stream of gas flowing in the exhaust pipes of a steam turbine. That invention is part of a larger scheme to remove liquid entrained in the exhaust steam flowing in the entire steam turbine exhaust system and to diminish exhaust pipe erosion in steam turbines, as set forth in U.S. Pat. No. 4,622,819 by Silvestri and Draper, and assigned to Westinghouse Electric Corporation. A Swiss design for a moisture preseparator also discloses the problem of corrosion from the moisture content of steam leaving a high pressure turbine and is described in "Moisture Separator and Cycle Efficiency Improvements by Installing Moisture Preseparators", von Bokh, Hutton & Patrick, ASME Joint Power Generation Conference Paper No. 84-JPGC-Pwr-30, 1984.

Moisture separated from the exhaust system is typically routed first to a collection tank and then to a moisture separator reheater drain tank. A major concern with respect to the incorporation of moisture preseparators into existing nuclear steam turbine systems is the avoidance of upsets in the drain system of the separator stage in the moisture separator reheaters. It has been found that the operating pressures of the moisture preseparators, customarily located close to the turbine exhaust, are higher than those of the drain lines from the moisture separator reheaters. The pressure differences are in the neighborhood of two to three percent of turbine exhaust pressure. There is also evidence of pressure recovery of steam velocity in the preseparator water collection zone, between the preseparator inner wall and either the exhaust snout or crossunder pipe wall. This phenomenon can increase the pressure differential to four percent of turbine exhaust pressure.

Given this pressure differential of two to four percent between the preseparator drains and the moisture separator reheater (MSR) drains, a direct coupling of the preseparator drain collection tank to the moisture separator reheater drain tank could result in flashing and could impair the drainage ability of the MSR, i.e., pockets of vapor could choke the drain pipes with the increased volume of drainage fluid and thereby reduce drainage flow. The expansion and contraction of the exhaust fluid, upon formation and collapse of pockets of vapor, causes cavitation and severe mechanical stress on system hardware. When flashing occurs in the drains of the preseparator system, it can be detected by an increase in the oscillation amplitude of the liquid level of the MSR drain tank.

One approach to solving the flashing problem has been to omit insulation on portions of the drain lines from the preseparator to reduce the water temperature, and hopefully, the pressure differential at the MSR drain tank. However, this approach has not been totally effective since increased oscillation amplitude of the MSR drain tank liquid level has been observed close to the high level turbine system trip setpoint despite reduction or elimination of insulation. Furthermore, this approach has economic disadvantages, i.e., an adverse effect on plant thermal efficiency and increased load in the plant cooling and ventilation system.

In some steam turbine systems, it is not feasible to route the liquid from the preseparator drain collection tank directly to the MSR drain tank, where the MSR drain tank may be located above the preseparator collection tank. Preseparator drain water is ordinarily saturated with vapor. If it were to flow uphill, the two-to-four percent pressure differential would result in flashing. Further, MSR drain tanks may have tank level control systems, such as a valve in the MSR drain line, which would be rendered ineffective by routing the preseparator drained liquid into the MSR exit drain line. In such a configuration, an alternative would be to rout the liquid from the preseparator drain tank to a heater with a level control and connection to the heater. This would require cutting a hole in the heater shell and welding on a pipe snout. However, pressure vessel codes and NRC regulations would most probably require that such a weld be X-rayed and the heater hydrotested. These procedures are expensive and not often feasible.

It is thus an object of the present invention to provide an effective and economical method and apparatus for routing the liquid from preseparator drains to the MSR without risk of flashing and which is adapted for retrofit applications involving retrofit installation of moisture preseparator drains.

SUMMARY OF THE INVENTION

The present invention provides a routing system for preseparator drain liquid, after it has exited the preseparator system, from its collection tank through an eductor and then to one or more MSR drain tanks. The eductor, which operates on the Venturi principle, serves the function of acting as a pump to accelerate the liquid and to further cool the liquid. The preseparator collection tank liquid is used as the suction fluid. The motive fluid is pressurized condensate taken from the discharge of one or more turbine feedwater heaters. The combination is then discharged into the MSR drain tank or tanks. The pressurized heater condensate is ordinarily cooler than the collection tank water. The eductor mixes the condensate with the collection tank water thereby producing eductor discharge water cooler than the collection tank water by ten to twenty degrees Fahrenheit. The cooler eductor discharge can now incur a much greater drop in pressure, from thirteen to twenty percent of turbine exhaust pressure, before the danger of flashing arises.

The collection tank for the preseparator drain water has a discharge line projecting inside the tank to maintain a minimum water level, which in turn provides for submerged entry of the preseparator drain water. This arrangement prevents the flow of steam down the preseparator drain pipes. The system also provides for spraying a small amount of heater condensate into the collection tank to slightly cool the drains in order to provide additional margin to protect against flashing in the line between the collection tank and the eductor.

Benefits of the invention include an overall increase in plant thermal efficiency, compared to the output loss of a conventional drain system without an eductor in which insulation is removed to cool the drain water from the preseparator. Another benefit is the reduction in size of the preseparator piping system downstream of the collector drain tank. A conventional system without eductor requires twelve to sixteen inch diameter drain lines to prevent flashing, whereas with the eductor, the drain line diameter can be reduced to six inches, resulting in significant savings in the cost of purchasing and installing a preseparator system.

BRIEF DESCRIPTION OF THE DRAWINGS

For a better understanding of the present invention, reference may be had to the following detailed description taken in conjunction with the accompanying drawings in which.

DESCRIPTION OF THE PREFERRED EMBODIMENT

Figure 1:
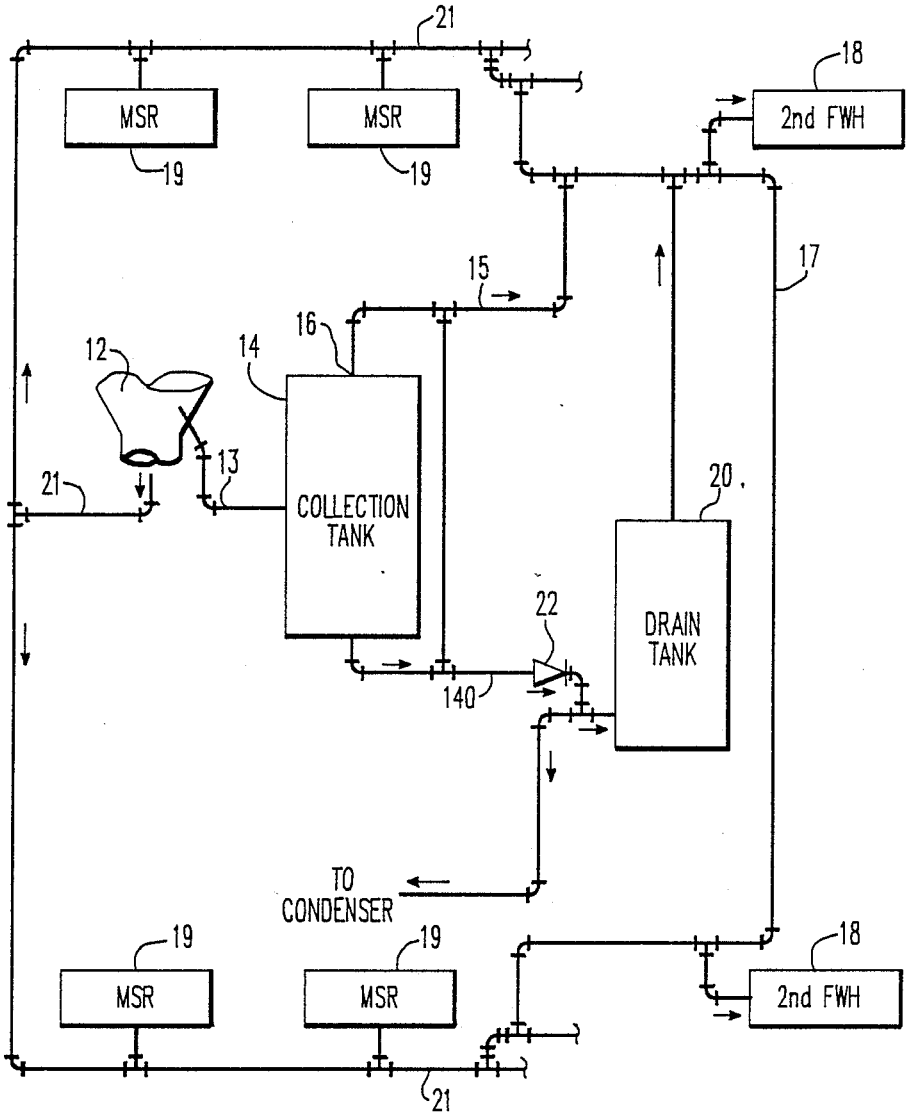
FIG. 1 PRIOR ART
FIG. 1 is a simplified schematic representation of a conventional preseparator drain routing system to a moisture separator reheater drain tank in one type of steam turbine.

A typical installation of a moisture preseparator drain system 10 in a nuclear steam turbine system is shown schematically in FIG. 1. Liquid separated from moisture-laden exhaust steam exits a turbine exhaust nozzle 12 and feeds into a collection tank 14. Typically, a high pressure steam turbine will have at least two steam exhaust nozzles or snouts 12, each of which will have a plurality of preseparation ports emptying liquid from exhaust nozzles 12 through one or more drain lines 13 into collection tank 14. Collection tank 14 is provided with a vent 16 through which vapor formed during transients is routed to second point feedwater heaters 18 via vent line 15 and extraction steam line 17. The illustrative system includes multiple moisture separator reheaters (MSR) 19 coupled to receive exhaust steam from nozzle 12 via various steam lines and cross-under piping 21.

From collection tank 14, preseparation liquid is routed into the moisture separator reheater drain tank 20, the flow into the tank being controlled by a non-return valve 22.

Figure 2:
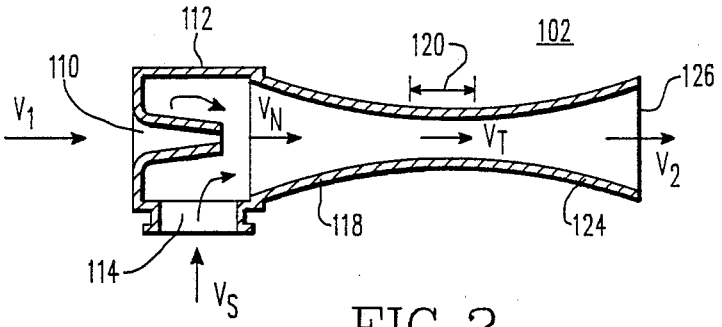
FIG. 2 is a cross-sectional view of one form of eductor which may be used with the present invention showing the direction, inlet, mixing, compression and discharge of both motive and suction fluid.

A schematic representation of the eductor portion 102 of the present invention 100 is shown in FIG. 2. The eductor operates in the well-known Venturi effect, a corollary of Bernouilli's Law. Eductor 102 has a nozzle end 104 equipped with nozzle 110 through which the motive fluid, represented by arrow V1, is projected into the eductor 102 towards the diffuser 116. The motive fluid is high pressure condensate from the discharge of one or more heaters, not shown. Preseparator collection tank drain liquid, or suction fluid, represented by arrow Vs, is entrained by motive fluid into eductor 102 through an inlet 114 in body 112 at the nozzle end 104. The motive fluid and suction fluid merge with a momentum interchange in the entrainment section 118 of the diffuser 116 wherein the body 112 tapers to a narrower throat section 120. The flow of the merged fluids through the entrainment section 118 is represented by arrow Vn. In the throat section 120, the merged fluids, indicated by arrow Vt, have reached a common velocity, i.e., the motive fluid has slowed and the suction fluids has accelerated. The last section 124 of eductor 102 has a reverse taper to an outlet 126 larger than the throat 120. In this last section 124, the velocity of the combined fluids undergoes a corresponding decrease. The outlet 126 discharges the combined fluids, indicated by arrow V2, at lower temperature and at higher pressure than that of the suction fluid, Vs, into line 140'. A momentum interchange between the suction fluid and the motive fluid takes place in the eductor and effects a heat and pressure exchange between the motive fluid V1 and the suction fluid Vs which substantially reduces the risk of flashing downstream of the eductor 102.

Figure 3:
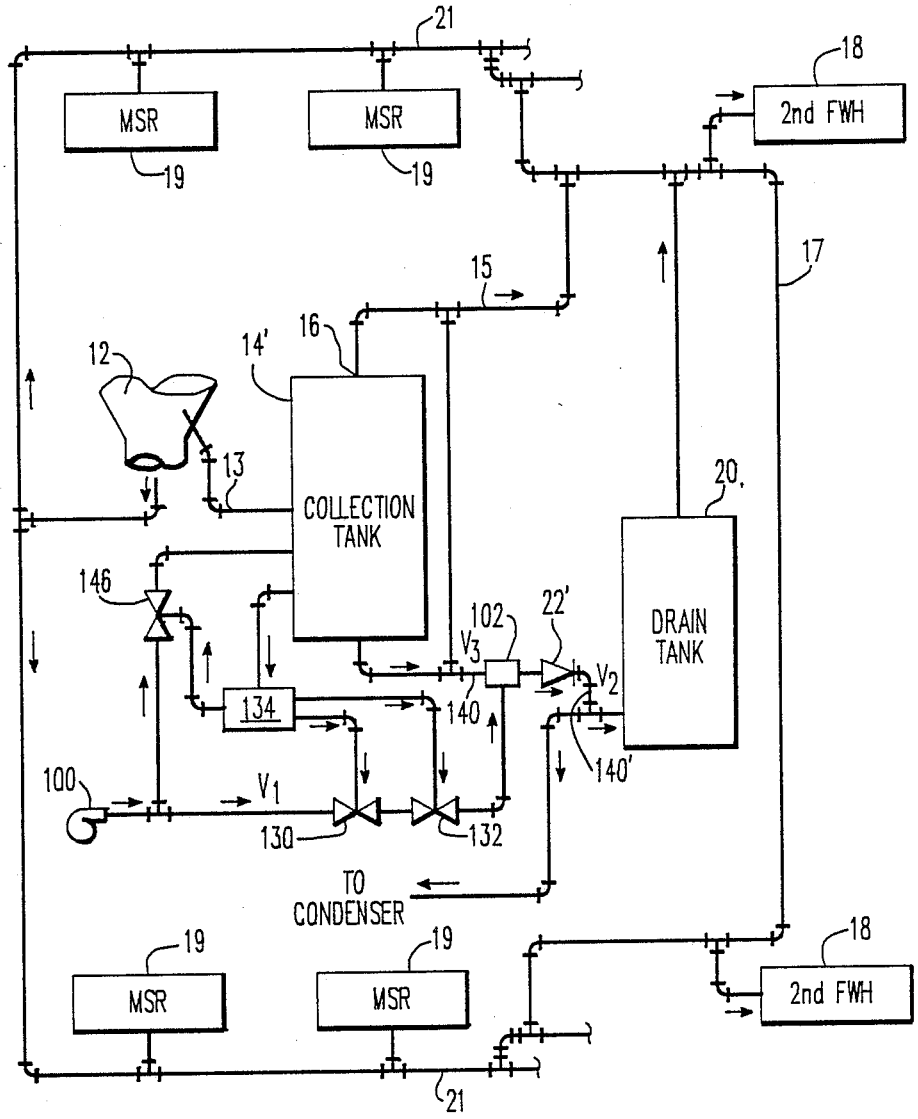
FIG. 3 is a simplified representation of an improved preseparator drain routing system incorporating the teachings of the present invention.

FIG. 3 is a schematic flow chart of the moisture preseparator drain system incorporating the teachings of the invention. It is identical in all respects to FIG. 1, except for the introduction of the eductor system. Eductor 102 is shown in line between collection tank 14' and non-return valve 22'. The motive fluid, V1, comes from a high pressure water supply, illustrated as a pump 100 although other sources of fluid at sufficient pressure and temperature are available within a turbine system as is discussed below.

The flow of motive fluid V1 is controlled upstream of eductor 102 by two valves, a shutoff valve 130 followed by a control valve 132. The valves 130 and 132 are controlled in response to water level in collection tank 14' (see level control or sensor 150 in FIG. 5). A controller 134 operates valves 130 and 132 to maintain a desired water level in tank 14'. The water level is selected to prevent flooding the tank so that water does not back-up into the exhaust system and to prevent the level from becoming so low that steam is pulled into the separator system. Preferably, V1 is tapped either from a main condensate discharge of a heater cascading other heater drains, or from the discharge of a heater pumping ahead the drain from another heater (in lieu of pump 100). In either case, the heater discharge will have elevational pressure head in excess of that of the preseparator collection tank fluid. The heater discharge requires conventional pumping in any event to its next destination, a second-point heater. Tapping some of this discharge to use as motive fluid for the eductor results in a very small relative power loss which is more than offset by reduced demands on other elements of the entire power plant, as will become evident further on in this disclosure.

Figure 4:
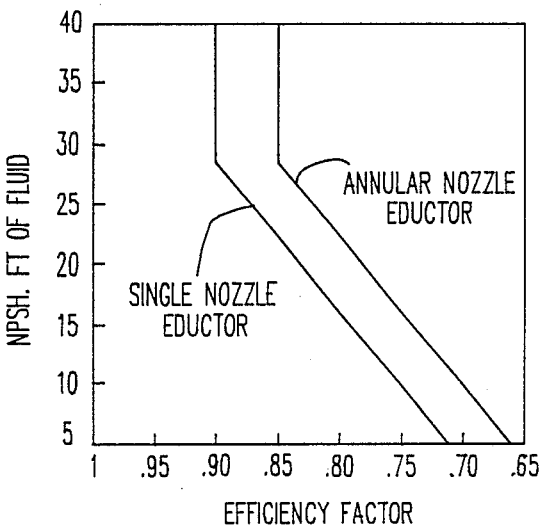
FIG. 4 is a graph of performance data of two types of eductors comparing NPSH versus efficiency factor over a range of operation.

FIG. 4 plots the performance characteristics of two types of eductor at various levels of net positive suction head (NPSH) and efficiency factor. The performance data of eductors was taken from Karassik, Krutzch, Fraser and Messina, Pump Handbook (McGraw-Hill, 1976). According to data published therein, three-and-a-half to six pounds of suction fluid can be pumped by one pound of motive fluid, depending on their respective pressures at the eductor. It is calculated from these data that the mixing of the motive fluid, pressurized condensate V1 from one or more turbine heaters with the preseparator drain collection tank liquid, Vs, would result in eductor water V2 cooler by ten to twenty degrees Fahrenheit than the collection tank liquid. V2 discharge at outlet 126 could incur a pressure drop of thirteen to twenty-one percent before it would flash.

Figure 5:
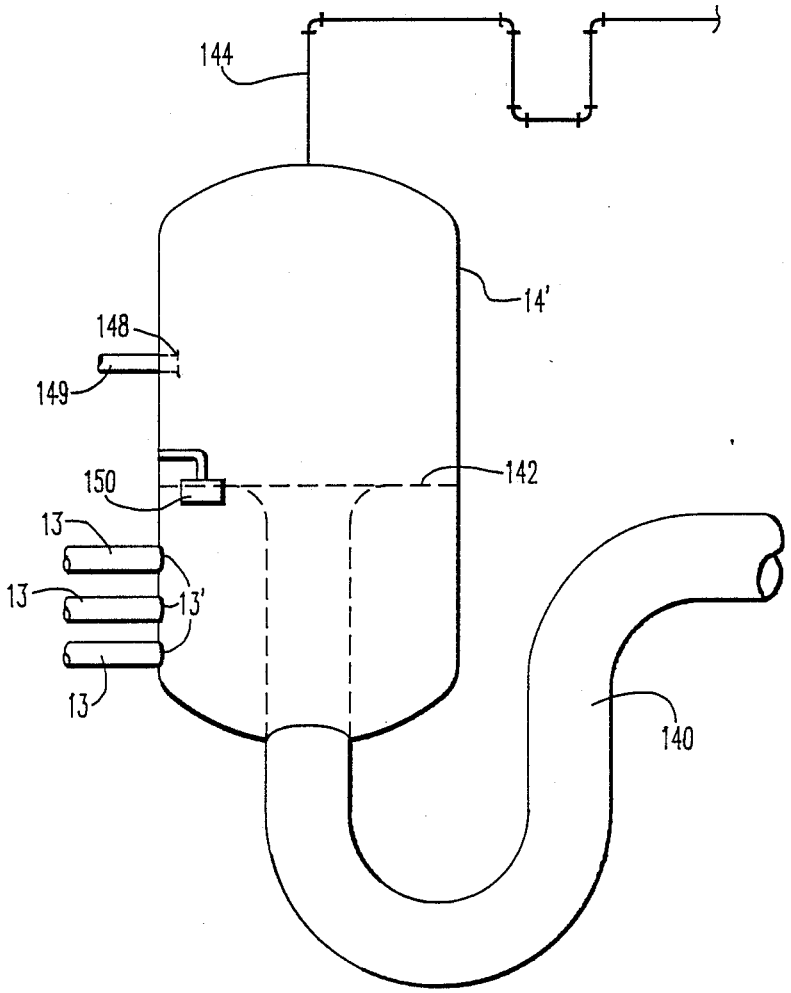
FIG. 5 is a planar view of a collection tank and drain line configuration used with the present invention, upstream of the eductor.

FIG. 5 shows collection tank 14' equipped with a discharge pipe 140 projecting upward within tank 14' to maintain water level 142 at sufficient height to allow submerged entry of drain lines 13 through apertures 14'. This feature of the invention will prevent unwanted steam flow down drain lines 13. A small vent line 144 is shown at the top of tank 14' which is routed to a downstream crossunder pipe, not shown. A sensor 150 senses the water level 142 and activates control valve 132 through controller 134 for controlling the flow of motive fluid V1 into eductor 102.

Another feature of the invention comprises spraying a small amount of cool heater discharge condensate into collection tank 14' to slightly precool the drain lines 13, thereby providing an extra margin of flash prevention in discharge pipe 140 between collection tank 14' and eductor 102. Such spray may be obtained from the source of the motive fluid, e.g., pump 100, coupled by a control valve 146 to tank 14'. A spray head 148 may be positioned in tank 14' and coupled to valve 146 by water line 149. The calculated pressure differentials produced by the invention as noted herein are based upon a lowering of the saturation pressure of the contents of the preseparator drain collection tank 14' by 5 p.s.i. through the use of this spray.

As previously noted, incorporation of the present invention into an existing nuclear powered steam turbine generator system will result in a small loss in power output of the generator system. The loss varies with heater drain configuration, supply pressure of the motive fluid, discharge pressure from the eductor collection tank water pressure and MSR drain tank elevation. In a system using motive fluid at 400 p.s.i., the output loss has been calculated to be between 117 kilowatts and 200 kilowatts out of a total output of 1,154,745 kilowatts, for condensate from a heater in a cycle which cascades all heater drains. For a different cycle configuration wherein the heater pumps ahead discharge from one or more other heaters, the loss would be between twenty-nine and thirty-four kilowatts. These losses are negligible in relation to the alternative loss of 106 kilowatts of output in the case of a conventional drain system, without eductor, which relies on omitting insulation from the drain line to cool the preseparator drain liquid. The calculated power loss for the conventional system is related to increased load upon plant ventilation and cooling caused by dissipation of heat from the uninsulated drain lines, and does not take into account efficiency losses and costs of other problems associated with flashing in the moisture separator reheater system, which are not effectively prevented by the conventional drainage system.

The foregoing calculations assume a mechanical efficiency of the eductor of twenty-five to thirty percent. New developments in eductors indicate mechanical efficiencies approaching forty percent. Accordingly, even lower power losses, as well as increased range in system performance from decreased quantities of motive fluid required, could be affected by using the improved eductors in the invention.

Another benefit of the invention is that it has little, if any, effect on existing plant ventilation and cooling systems. In contrast, as previously mentioned, a preseparator installation using a conventional drain system without eductor makes additional demands on the ventilation systems in the area adjacent to the preseparators. The ventilation systems in some existing plants do not have the capacity for added heat load.

Still another major benefit of the present invention is the reduction in the size of the preseparator drain pipe 142 downstream of the collection tank 14'. Without eductor 102, twelve to sixteen inch diameter pipe is required to protect against flashing. With eductor, the diameter of pipe 142 may be reduced to six inches. This results in a substantial saving in equipment and installation costs of an entire preseparator system.

Lastly, the subject invention is useful over a wide range of preseparator moisture removal effectiveness. For example, the twelve and sixteen inch drain lines now in use as drain lines are typical for a preseparator effectiveness approaching thirty-five percent of total turbine exhaust moisture removal. In the event a higher level of moisture removal is achieved, the eductor system is more easily adapted to accommodate such improvements in conventional drain systems.

The schematic representations shown in the drawings are exemplary and do not exhaust the possibilities of alternative configurations employing an eductor in the preseparator drain system. There are situations where it is desirable to connect the eductor directly to the preseparator drain lines. For instance, a combined turning vane elbow/preseparator can be installed at ground level and have a preseparator drain line running uphill to its collection tank. Flashing is inevitable in this configuration. As a result, drainage problems can occur and have a deleterious effect on plant operation and performance. This type drainage problem can be eliminated by installing an eductor in the drain lines upstream of the collection tank in accordance with the present invention.

What is claimed is:

1. In a steam turbine system employing a moisture preseparator drain system for erosion-prevention in exhaust piping between the steam turbine exhausts and one or more moisture separator drain tank, a flash-preventing system for preseparator drain liquid extracted from steam exiting turbine exhausts, comprising:

eductor means disposed between a preseparator drain system and a moisture separator drain tank for suctioning preseparator drain liquid toward said moisture separator drain tank;

a source of motive fluid coupled to said eductor means, said motive fluid being at lower temperature and higher pressure than said preseparator drain liquid;

first pipe means for delivering said preseparator drain liquid from said turbine exhausts to said eductor means;

second pipe means for delivering liquid discharged from said eductor means to said moisture separator drain tank; and control means for controlling flow of said motive fluid into said eductor means.

2. In a steam turbine system employing a moisture preseparator drain system for erosion-prevention of exhaust piping between the steam turbine exhausts and one or more moisture separator drain tanks, which drain system includes drain lines opening into a collection tank for collecting preseparator drain liquid removed from steam exiting the turbine exhausts, the collection tank being upstream of the moisture separator drain tank, a flash-preventing system for preseparator drain liquid exiting the collection tank, comprising:

eductor means disposed between the collection tank and the moisture separator drain tank, for suctioning liquid from the collection tank;

a source of motive fluid coupled to said eductor means, said motive fluid being at a lower temperature and a higher pressure than liquid in the collection tank;

first pipe means for delivering liquid from the collection tank to said eductor means;

second pipe means for delivering liquid discharged from said eductor means to the moisture separator drain tank; and control means for controlling flow of said motive fluid into said eductor.

3. The system according to claim 2 wherein said control means comprises:

a flow control valve coupled between said motive fluid source and said eductor means;

sensor means within the collection tank for detecting the level of liquid within the collection tank; and means coupled to said sensor means and responsive thereto for controlling said flow control valve.

4. The system according to claim 3 wherein said control means further comprises a shutoff valve coupled in series arrangement with said flow control valve.

5. The system according to claim 2, further comprising spray means for spraying cool liquid within the collection tank for precooling said preseparator drain liquid entering said tank, a source of cool liquid, and delivery means for delivering said cool liquid to said spray means.

6. The system according to claim 4 wherein said first pipe means projects upward within the collection tank so that liquid leaving the collection tank via said first pipe means exits at an elevation above any opening through which the drain lines enter into the collection tank for providing submerged entry of the preseparator drain liquid into the collection tank for inhibiting steam backflow into the drain lines.

7. In a steam turbine employing a moisture preseparator drain system for erosion-prevention of exhaust piping between the steam turbine exhausts and one or more moisture separator drain tanks, which drain system includes drain lines opening into a collection tank for collecting preseparator drain liquid removed from steam exiting the turbine exhausts, the collection tank being upstream of the moisture separator drain tanks, a flash-preventing system for preseparator drain liquid exiting the collection tank, comprising:

eductor means disposed between the collection tank and the moisture separator drain tank, for suctioning liquid from the collection tank;

a source of motive fluid coupled to the eductor means, said motive fluid being at lower temperature and higher pressure than the collection tank liquid;

first pipe means for delivering the collection tank liquid from the collection tank to said eductor means;

second pipe means for delivering liquid discharged from said eductor means to the moisture separator drain tank;

control means for controlling flow of said motive fluid into said eductor means, said control means comprising a flow control valve and a liquid level sensor within the collection tank for controlling the flow control valve in response to the level of liquid within said collection tank such that the amount of flow of motive fluid into said eductor means varies with the level of liquid to be suctioned from the collection tank by said eductor means;

spray means for spraying a cool liquid into the collection tank for precooling the preseparator drain liquid entering the collection tank;

a source of cool liquid for said spray means;

delivery means for delivering said cool liquid to said spray means; and submerged entry means for the drain lines entering into the collection tank, said first pipe means projecting upward within the collection tank so that liquid leaving the collection tank via said first pipe means exits at an elevation above that at which the drain lines enter the collection tank.

* * * * *